United States Patent [19]
Newcomb et al.
[11] Patent Number: 4,479,649
[45] Date of Patent: Oct. 30, 1984

[54] ILLUMINATED PLAYBALL

[76] Inventors: Nelson F. Newcomb; Nelson F. Newcomb, Jr., both of Mirror Lake, N.H. 03853

[21] Appl. No.: 499,985

[22] Filed: Jun. 1, 1983

[51] Int. Cl.³ ..... A63B 41/00
[52] U.S. Cl. ..... 273/61 R; 273/61 D; 273/58 G; 273/DIG. 24
[58] Field of Search ..... 273/58 B, 58 G, 58 H, 273/65 EC, 65 ED, 65 D, 61 D, DIG. 24, 61 R

[56] References Cited

U.S. PATENT DOCUMENTS

| | | | |
|---|---|---|---|
| 2,499,483 | 3/1950 | Foy | 273/58 B X |
| 3,229,976 | 1/1966 | Allen | 273/58 G |
| 4,015,111 | 3/1977 | Spector | 273/DIG. 24 X |
| 4,086,723 | 5/1978 | Strawick | 273/DIG. 24 X |
| 4,340,222 | 7/1982 | Kerkenbush et al. | 273/61 R |

FOREIGN PATENT DOCUMENTS

| | | | |
|---|---|---|---|
| 662796 | 5/1963 | Canada | 273/65 D |
| 328081 | 4/1930 | United Kingdom | 273/61 R |
| 529271 | 11/1940 | United Kingdom | 273/58 G |

*Primary Examiner*—George J. Marlo
*Attorney, Agent, or Firm*—C. Yardley Chittick

[57] ABSTRACT

A playball made of translucent plastic and illuminated for play in the dark by an insertable and removable chemi-luminescent device known as a light stick. The weight of the light stick is less than 1% of the weight of the ball. The ball includes a self-closing valve whereby the ball may be inflated and deflated in conventional manner. The light stick just prior to use is activated and then inserted through a preformed passage in the uninflated ball. The inserted light stick is supported radially within the ball by a thickened inwardly extending translucent plastic post that is integral with the ball wall. Subsequent inflating of the ball to playing pressure causes the compressible post to grip the light stick tightly enough to prevent expulsion during use. Thereafter when an exhausted light stick is to be replaced, the ball is deflated to release the grip of the post, the ball is manually collapsed to bring pressure against the interior end of the light stick thereby forcing it out of the ball far enough to be gripped by hand and pulled out. A new activated light stick may then be inserted so that play may resume.

3 Claims, 5 Drawing Figures

ILLUMINATED PLAYBALL

BACKGROUND OF THE INVENTION

Playballs illuminated by chemi-luminescent material for play after dark are known in the art. See for example the U.S. Pat. No. 4,015,111 to Spector. The concept of placing the necessary chemical components in a flexible sealed transparent plastic container and maintaining them in unactivated condition until activation is desired, is well understood. See the U.S. Pat. No. 3,576,987 to Voight et. al. In general, it may be stated that playballs illuminated by the light stick of U.S. Pat. No. 3,576,987 or the globular lighting assemblies of U.S. Pat. No. 4,015,111 have not come into any appreciable use because of the difficulty of mounting the lighting means in the ball in a manner permitting easy removal and replacement when exhausted. It has been found however that both the globular lighting assembly of U.S. Pat. No. 4,015,111 and the light stick assembly of U.S. Pat. No. 3,576,987 are capable of providing adequate illumination of all conventional sized translucent walled inflatable playballs such as for example footballs, basketballs, soccer balls, and tennis balls.

Playballs have also been interiorly illuminated by injection of chemi-luminescent liquid directly into the ball by a syringe type needle inserted through a conventional self-closing valve mounted in the wall of the ball. This method although very effective from a lighting standpoint, is however considered by some users as unsatisfactory due to possible contamination of skin and clothing by careless handling of the liquid.

SUMMARY OF THE INVENTION

In view of the foregoing reference to the background of the invention, it has become apparent that users of illuminated playballs prefer a source of chemi-luminescent light that is in a self-contained unit which may be inserted into and removed from the playball without the use of tools or other special equipment. Furthermore, the structure of the ball adapted to receive and hold in position such lighting unit must be uncomplicated to minimize cost and facilitate use.

Applicants' novel structure meets the foregoing requirements. The chemi-luminescent unit is in the form of a small light stick weighing about ½ gram and having a length to diameter ratio of about 8 to 1. Thus, with a diameter of 3/16 inch, (only a little larger than a wooden match) the light stick may be easily inserted by hand into a smaller preformed passage in the ball wall.

The problem of maintaining the light stick in proper position within the ball has been resolved by forming as an integral part of the ball an inwardly extending translucent post having an axial bore capable of receiving a light stick when the latter is pressed therein by hand. The dimensions of the post are a matter of choice provided it is rigid enough to maintain the light stick in substantially a radial position at all times and has enough compressibility so that when the ball is inflated to playing pressure, the light stick will be gripped along its cylindrical surface tightly enough to prevent expulsion by the ball pressure.

From the above, it will be appreciated that a conventional playball made of translucent plastic and including in its wall a conventional self-sealing valve utilized for pumping the ball up to desired playing pressure, is modified merely to the extent of adding a tubular post into which the light stick may be inserted and automatically secured upon inflation. The location of the post may be anywhere in the spherical surface of the ball but preferably it will be diametrically opposite the self-sealing valve which is of about the same small weight as the light stick and post.

The combined weights of the valve, post and light stick are so small relative to the ball weight, as to have no observable or behavioral effect on the ball in play and may therefore be disregarded. The length of the bore through the post provides a cylindrical interior surface sufficient to not only hold the light stick against ejection by internal ball pressure but also to hold the light stick in a fixed position (approximately radial) within the ball regardless of conditions of use. Balls incorporating the above structure have been used extensively in all manner of play without dislodgment or damage to the light stick.

The other essential feature of the invention is the means and method of substitution of a new light stick for an exhausted one. This is accomplished by inserting a hollow needle in the self-sealing valve and deflating the ball so that it may be compressed hand to an extent permitting the wall opposite the light stick to be pressed against the inner end of the light stick.

In this manner, the light stick can be then forced out of the ball at least enough to permit it to be gripped by hand and pulled out.

Upon removal of the exhausted light stick, a new one, activated by bending the stick to breach the interior liquid separating means, may then be inserted in the stick holding post. The stick is pressed in until the outer end of the stick is substantially flush with the exterior surface of the ball. In this position, it is automatically and adequately secured within the post upon reinflation in the usual manner to playing pressure.

DESCRIPTION OF A PREFERRED EMBODIMENT

The accompanying drawings disclosing one embodiment show the invention as applied to a playball of tennis ball size.

The ball herein described and incorporating the invention is of tennis ball size, about 2 ½" in diameter and weighing about 2 ounces. However, it will be understood that the invention is equally applicable to balls of other dimensions and shapes so long as they incorporate a self-sealing valve and the novel means for removably supporting a light stick in the ball interior. As the description proceeds, it will be noted that the weight of the light stick is exceedingly small in relation to the ball weight and accordingly has no appreciable effect on the behavior of the ball in play. On the other hand, the light stick despite its small relative weight provides adequate illumination of the translucent ball in which it is positioned.

Figure 1:
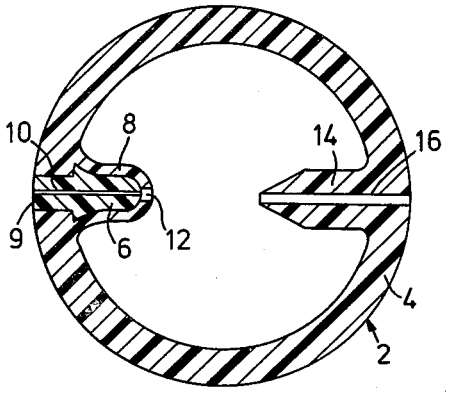
FIG. 1 shows in cross section the ball as initially manufactured.

Referring first to FIG. 1 the ball 2 is shown in its initially manufactured form. The wall 4 is made of relatively thick translucent strong, flexible plastic. A conventional self-closing valve 6 of the type used in the inflating of playballs is securely and permanently mounted in the interior, being held in place by a cover 8 which completely encases the valve and is integral with the wall material.

Figure 5:
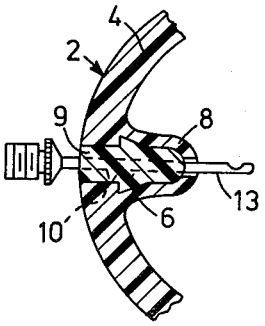
FIG. 5 is a fragmentary cross sectional view showing the hollow needle in position in the self-closing valve.

Valve 6 has its outer end 9 exposed and flush with the ball surface. The normally closed axial passage 10 terminates at its inner end in alignment with an opening 12 in cover 8. It will be understood that when the ball is to be inflated, a hollow needle 13 (see FIG. 5) will be inserted through passage 10 whereby the ball may be filled with compressed gas (normally air) to the desired playing pressure. Likewise, it will be understood that when the ball is to be deflated, the same hollow needle, now disconnected from the compressed air source, may again be inserted through valve 6 allowing the compressed air to escape.

The self-closing valve 6 herein referred to is an essential element of the ball whereby the ball may be inflated and deflated to meet the operating conditions hereinafter explained in detail.

Still referring to FIG. 1, the ball as manufactured has an inwardly extending tubular post 14 which is of the same material as the ball wall 4 and is an integral part thereof. The post has an axial bore 16 of such diameter that, when considered in relation to the elasticity of the post material, it may receive therein by manual insertion a light stick 18 of larger diameter in the manner illustrated in FIG. 2. The nature of the light stick will be explained hereinafter.

At this point in the description, it is to be emphasized that the size of the bore 16 in post 14, the frictional characteristics of the wall of bore 16 and the elasticity of the post material, all combine to make possible the easy insertion in bore 16 of a light stick substantially larger in diameter than the bore.

The post 14 is preferably located diametrically opposite valve 6 whereby the weight of the valve 6 and cover 8 will be substantially balanced by the weight of post 14 and light stick 18 thereby to eliminate eccentricity of rotation during play.

Figure 4:
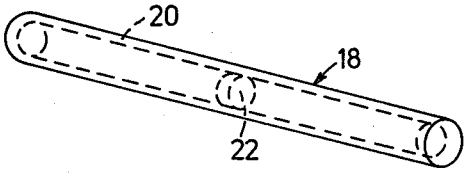
FIG. 4 is perspective view of a light stick drawn to enlarged scale.

The light stick 18 previously referred to is the means for providing illumination of the ball. This device is a unit made, preferably, according to the teachings of U.S. Pat. No. 3,576,987 but not limited thereto. The light stick is in the form of a closed tube 20 containing two liquid chemicals separated by a frangible divider 22. See FIG. 4. The tube while generally rigid may be bent sufficiently to break or dislodge the divider permitting the chemicals to mix and thereby react to produce chemi-luminescent light.

The light stick currently being used is approximately 1 7/16" long, 3/16" in diameter and weighs less than ½ gram which is less than 1% of the ball weight but it is to be understood that no limitations are to be placed on the particular dimensions except as required by the claims.

When the ball is to be put into play, the following steps are followed. The light stick is activated by manual bending. It is then forced into bore 16 of post 14 for its full length to assume the air tight position shown in FIG. 2. The light emitted by the light stick is adequate to illuminate ball 2 over its entire surface excepting the very small area at the end 9 of valve 6. The hollow needle connected to the compressed air supply is inserted in valve 6 (see FIG. 5) and the ball is inflated to the desired playing pressure. The needle is then removed with valve 6 automatically closing, leaving the ball then in playing condition.

It might be thought that as the pressure in the ball increased, the light stick would be blown out of post 14. This however does not occur because the elasticity and flexibility of post 14 is such that the increasing air pressure compresses post 14 radially to grip the light stick so tightly that outward axial movement within post 14 is precluded.

After a length of time determined by the characteristics of the light stick, the illuminating capability becomes exhausted so if play is to continue the light stick must be replaced.

Figure 3:
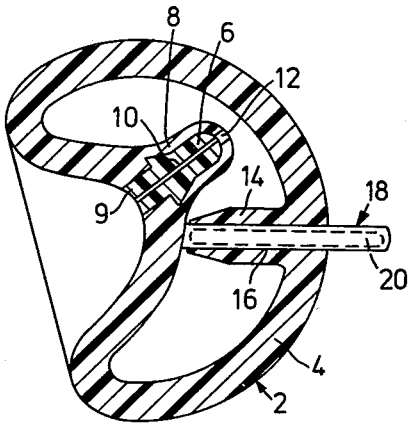
FIG. 3 shows in cross section the procedure used to remove an exhausted light stick with the ball deflated.

The procedure for removing the exhausted light stick is as follows: A hollow needle the same as that used in inflating the ball (see FIG. 5) is inserted into the ball through valve 6 allowing the ball pressure to fall to atmospheric. The ball may then be manually distorted inwardly as illustrated in FIG. 3 with the inner wall adjacent valve 6 engaging the inner end of light stick 18 and forcing it out far enough to be gripped by the fingers and pulled out.

Figure 2:
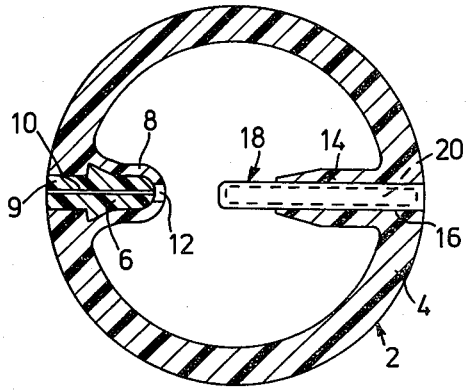
FIG. 2 shows in cross section the ball with the activated light stick inserted in operative position.

With the exhausted light stick removed, the ball will again be in the condition shown in FIG. 1 ready for the insertion of a new activated light stick as shown in FIG. 2. This is followed by the usual inflation procedure, again putting the ball in playing state.

An alternative procedure to ready a ball for subsequent rather than immediate use is this. With the ball in the condition shown in FIG. 1, a new unactivated stick is inserted only part way into the post 14. Enough of the stick 18 is left extending so that it can be bent at a later time to start the chemical lighting reaction. While the stick 18 is only part way in the bore 16 it is, nevertheless, in air tight engagement so that the ball can, if desired, be fully inflated. Then subsequently, when the ball is to be put to use, the light stick 18 can be bent and activated and then pushed the rest of the way into the post 14 without any loss of pressure.

By this alternative procedure a quantity of balls may be readied for subsequent use by the simple expedient of activating the light stick 18 and pressing the stick the full distance into the post 14.

It is intended to cover all changes and modifications of the example of the invention herein chosen for purposes of the disclosure which do not constitute departures from the spirit and the scope of the invention.

We claim:

1. An article of manufacture comprising a molded, hollow, spherical ball made of airtight, flexible, elastic, translucent plastic material, a self-sealing valve mounted on the interior wall of said ball and enclosed within a covering of said material that is molded thereabout simultaneously with the molding of said ball, a light stick supporting post extending radially inward from said interior wall at a position substantially diametrically opposite said valve, said post being of the same said material as said ball and molded integrally therewith, said post and wall from which said post extends having a continous open radially directed bore therethrough of a size adapted to accept under endwise manual pressure a light stick of larger diameter than said bore, and a light stick adapted to be positioned in said post, the length of said light stick being such that when said light stick is positioned in said post its outer end is flush with the outer surface of said ball and its inner end extends beyond the end of said post, the character of said post being such that when said light stick is positioned therein and in activated condition, the light given off by said light stick will in part effectively pass through the surrounding wall of said post and in part will emanate directly from the free inner end of said light stick, the total light from said light stick being adequate to illuminate substantially the entire ball to a degree enabling said ball to be used in the dark.

2. The article of manufacture set forth in claim 1, the weight of said valve and its covering and the weight of said post and said light stick mounted therein being so nearly equal that there will be no noticeable effect on the ball when in play.

3. The article of manufacture set forth in claims 1 or 2, said light stick weighing less than 1% of the weight of said ball.

* * * * *